US007735152B2

(12) United States Patent
Golle

(10) Patent No.: US 7,735,152 B2
(45) Date of Patent: Jun. 15, 2010

(54) EL LIGHTED GARMENT WITH TEAR AWAY FEATURE

(75) Inventor: Aaron Golle, Shakopee, MN (US)

(73) Assignee: Safe Lites, LLC, Eden Prairie, MN (US)

( * ) Notice: Subject to any disclaimer, the term of this patent is extended or adjusted under 35 U.S.C. 154(b) by 0 days.

(21) Appl. No.: 11/675,488

(22) Filed: Feb. 15, 2007

(65) Prior Publication Data

US 2007/0199128 A1 Aug. 30, 2007

Related U.S. Application Data

(60) Provisional application No. 60/743,298, filed on Feb. 15, 2006.

(51) Int. Cl.
*A41D 1/04* (2006.01)

(52) U.S. Cl. ..... 2/102

(58) Field of Classification Search ..... 2/94, 2/102, 69, 93, 108, 83; 362/103, 108, 84, 362/189; 224/902
See application file for complete search history.

(56) References Cited

U.S. PATENT DOCUMENTS 4,328,533 A * 5/1982 Paredes ..... 362/108
4,839,777 A * 6/1989 Janko et al. ..... 362/108
5,070,436 A * 12/1991 Alexander et al. ..... 362/108
5,211,321 A * 5/1993 Rodriguez ..... 224/604
5,249,106 A * 9/1993 Barnes et al. ..... 362/108
5,570,945 A * 11/1996 Chien et al. ..... 362/84
6,085,698 A * 7/2000 Klein ..... 119/859
6,405,378 B1 * 6/2002 Garner ..... 2/102

* cited by examiner

*Primary Examiner*—Tejash Patel
(74) *Attorney, Agent, or Firm*—Schwegman, Lundberg & Woessner, P.A.

(57) ABSTRACT

Shown herein is an example embodiment of a garment or other article of clothing with EL lighting and tear away functionality. In one example embodiment, the garment or article is a safety vest that includes an EL lighting assembly wherein the vest and the assembly are adapted to allow at least a portion of the article to be torn away in the event the article is accidentally caught in a machine or vehicle. In one embodiment, tear away functionality is provided by providing a line of weakness in the article at the shoulders that allows the article to separate if pulled with sufficient force, and also with a "pull-apart" connector in the EL lighting assembly that is positioned at about the location of the line of weakness.

20 Claims, 12 Drawing Sheets

EL LIGHTED GARMENT WITH TEAR AWAY FEATURE

This application claims the benefit of priority, under 35 U.S.C. §119(e), to U.S. Provisional Patent Application Ser. No. 60/743,298 filed on Feb. 15, 2006, which is incorporated herein by reference.

TECHNICAL FIELD

The present invention pertains generally to safety articles, systems and methods, and more particularly to methods and articles pertaining to illuminating human or animal subjects, particularly in situations involving poor visibility due to lighting or weather conditions.

BACKGROUND ART

The risk of injury or death in job-related traffic accidents is a principle concern to public safety and highway workers. In addition, such risks are also present for civilians who use roadways for such activities as walking, running or biking. These risks are particularly acute in poor lighting conditions as may occur at night or during inclement weather. As a result, there is a need for improvements in safety for such workers, and others engaging in outdoor activities in conditions of poor visibility. One tried and true method for reducing the chances for an unwanted accident is the use of reflective safety clothing, for example safety vests worn by highway workers and public safety workers, or reflective clothing, shoes, hats or other articles worn by civilians. Improvement of such safety related articles can yield important and precious reductions in road accidents and fatalities, and as a result are highly desirable.

DISCLOSURE

Figure 1:
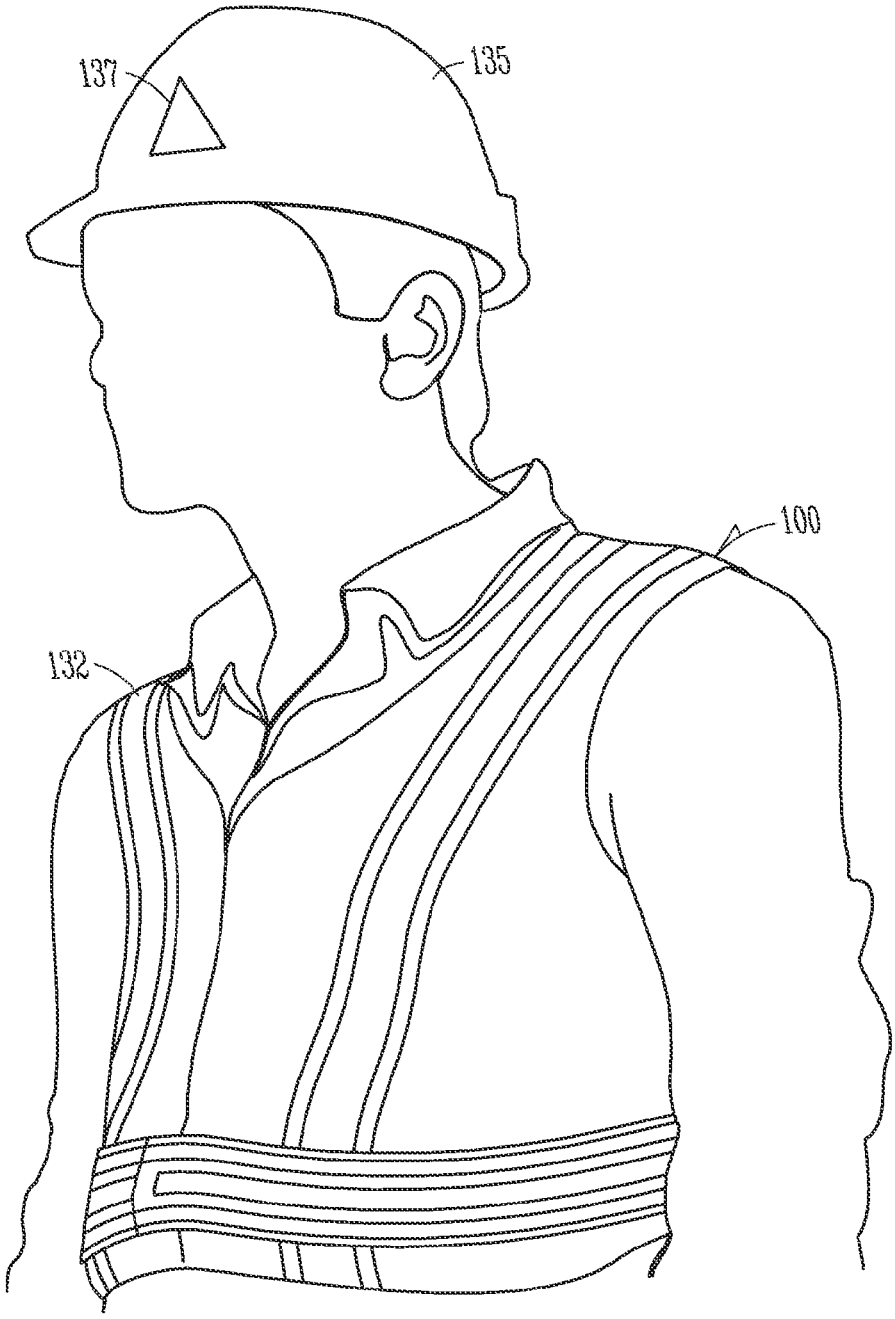
FIG. 1 shows a person wearing a safety vest and safety hat according to an embodiment of the invention.
Figure 2:
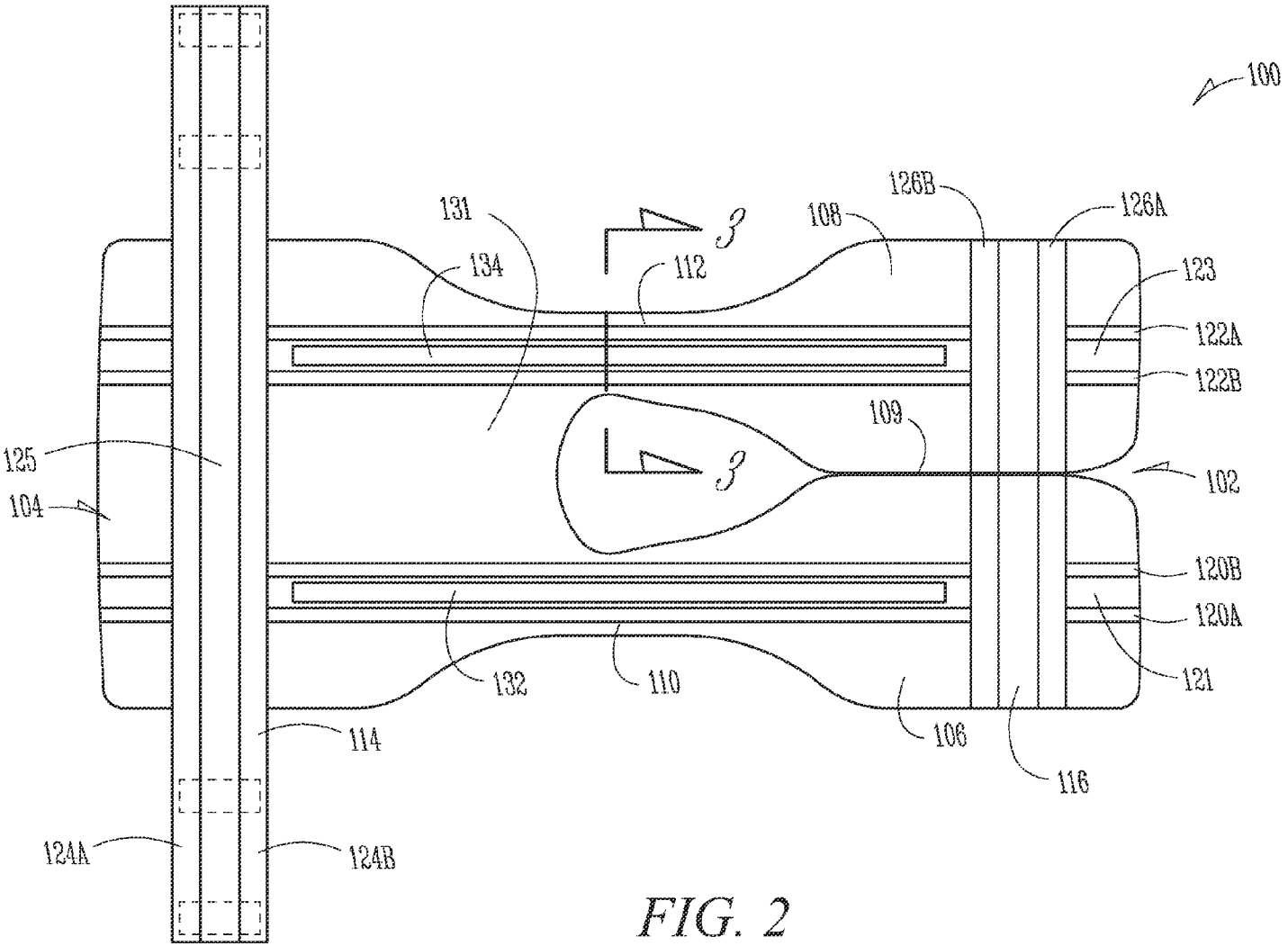
FIG. 2 shows a flat view of a vest according to an embodiment of the invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. Referring now to FIGS. 1 and 2 there is illustrated a first embodiment of a safety article of clothing according to the present invention, and in particular a safety vest 100. Vest 100 is sized to be worn by a human, as shown in FIG. 1. FIG. 2 shows the vest 100 laid out in a flat orientation to better illustrate the relationship of elements of the vest 100. FIG. 2 shows the vest 100 including a front side 102, a back side 104, a front right side 106 and a front left side 108. In one embodiment, a seam 109 is included that allows the front right side 106 to separate from the front left side 108 for ease of putting on and taking off the vest 100. In one embodiment, the interface 109 includes at least one fastening device, such as a zipper or buttons, etc. Although portions of a vest shown include a front side 102, a back side 104, a front right side 106 and a front left side 108, not all of these portions need be present within the scope of the invention. For example, in one embodiment, a vest includes a left and a right front side, and a portion going around a neck of a user.

The front and back sides 102 and 104 are connected with left and right shoulder portions 110 and 112, respectively. A waist band/belt 114 is further provided, and is adjustable so that the vest can be secured around the torso of a user. According to one example embodiment, a Velcro system 116 is used on at least one side of the vest to allow the waist band to be tightened and secured in place when worn by a user, and to be loosened and disconnected to allow the vest to be put on and taken off.

According to the embodiment of FIGS. 1 and 2, the vest 100 includes reflective stripes 120*a* and 120*b* and 122*a* and 122*b* that run respectively on the left and right sides of the vest up the front and over the shoulder portions and down the back. In addition, vest 100 includes reflective stripes 124*a* and 124*b* on the waste band that extend all the way around the back of the vest. In one embodiment, further reflective stripes 126*a* and 126*b* are included on front portions of the vest 100. Reflective stripes 120*a*, 120*b*, 122*a*, 122*b*, 124*a*, 124*b*, 126*a*, and 126*b* are all, in one embodiment a light or white colored material EL that reflects light for example from the headlights of a vehicle. In addition, in one example embodiment, these stripes are divided by a yellow colored stripe 121, 123 and 125, that provides for enhanced visibility during the day and to indicate caution to an oncoming vehicle.

In one embodiment, the reflective stripes 126*a* and 126*b* are divided by portions of Velcro system 116. Still further, the remaining portion of the vest 131 is, in one example embodiment, colored a yellow or other easily seen color. One possible alternative color for the remaining portion of the vest 131 includes safety orange. The reflective stripes are formed of any suitably reflective material such as glass bead enhanced material, reflecting polymer material, etc. The yellow, safety orange, or other color may also include a reflective material to provide further enhanced visibility of this portion of the vest in the presence of an external light source such as a headlight.

According to still another aspect of the embodiment of FIGS. 1 and 2, there is provided electroluminescent lamp (EL) strips 132 and 134 on each side of the vest extending from the front of the vest over the shoulder to the back of the vest, and in this example disposed along or on top of the colored stripes 121 and 123, respectively. In the following description, EL light elements will be referred to as EL strips. Although a strip geometry is discussed in various embodiments, several geometries such as squares, circles, arcs, tubes, cylinders, combinations thereof, etc. are possible using EL light elements.

Figure 3:
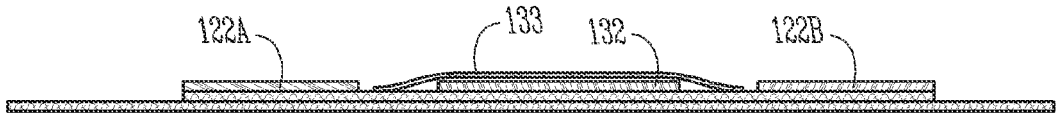
FIG. 3 shows a cross section view along line 3-3 from FIG. 2.

As shown in FIG. 3, in one embodiment, the EL lamp strips are held in place on the vest inside a protective transparent plastic sleeve 133. One embodiment of plastic sleeve 133 includes a polyurethane sleeve. According to one example embodiment, the plastic material used in the sleeve is selected so that it maintains flexibility in cold temperatures so the vest is comfortable to wear and not unduly stiff. According to one example embodiment, the EL lighting strips are provided by Durel Corporation, located at 2225 W. Chandler Blvd., Chandler, Ariz. 85224-6155. In one configuration, the EL lamp strips are sized to be approximately ½ inch wide, and vary in length depending on the clothing configuration.

Figure 4:
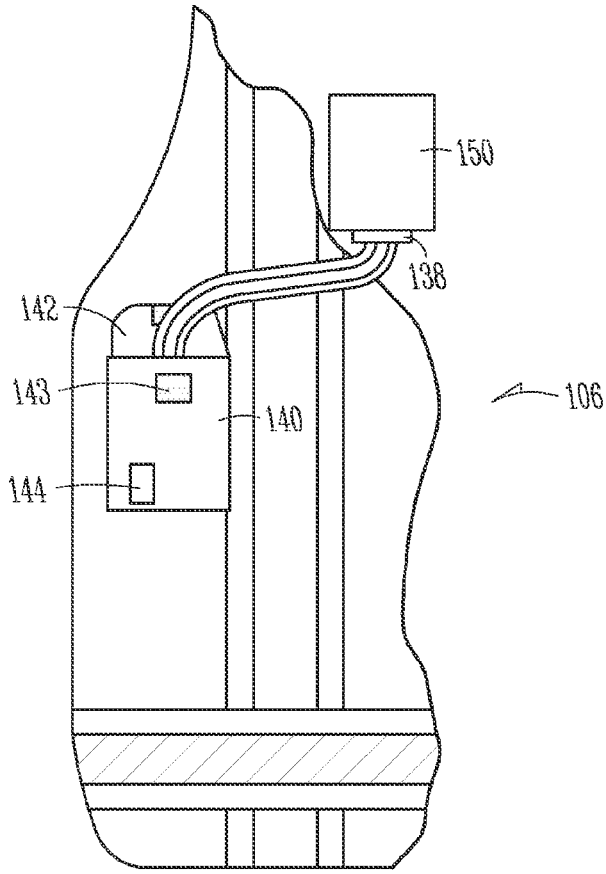
FIG. 4 shows a view of one side of a vest according to an embodiment of the invention.

As shown in FIG. 4, vest 100 includes a pocket 140. In one embodiment, the pocket 140 is located on an outside surface of the front right side 106. The pocket 140 is adapted for holding an electrical pack 150. An outside location allows the battery to be easily accessed for replacement or removal if necessary for recharging, for example using a cigarette lighter recharging device or one that operates off of line voltage such as 110 volt AC power. In one embodiment, the pocket 140 includes a closing flap 142. In one embodiment a pocket securing device, such as a Velcro portion 143 is included to secure the closing flap 142. In one embodiment, the pocket 140 includes an access opening 144. The access opening 144 allows a user to actuate a control such as a power switch on the electrical pack 140 without opening the closing flap 143. Alternative locations for the electrical pack 150 includes a pocket on the inside of the vest.

The electrical pack 150 includes a power source for powering the EL lighting strips. Examples of suitable power sources include, but are not limited to, disposable batteries, rechargeable batteries, etc. In one embodiment, the electrical pack 150 further includes control electronics such as an electrical inverter, or other electronics. In one embodiment, a power source and control electronics are located separately, and are not packaged together in the electrical pack 150. In one embodiment, the electrical pack 150 is electrically connected to strips 132 and 134 through a detachable connector 138 allowing the electrical pack 150 to be removed from the vest if desired for reasons such as recharging batteries. Suitable batteries include alkaline, nickel-cadmium, nickel-metal hydride, etc.

Figure 5A:
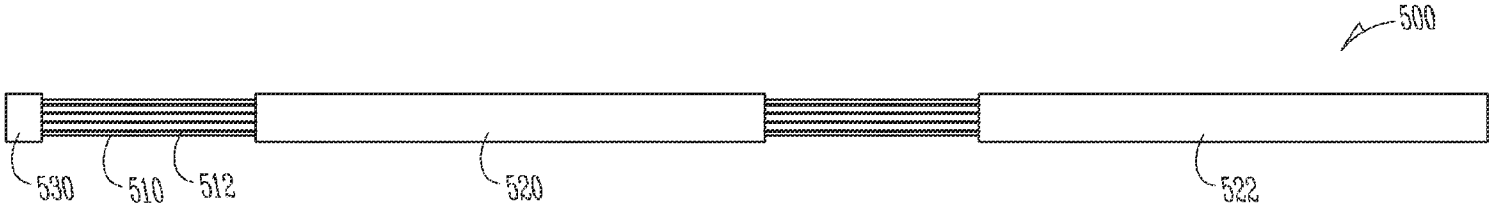
FIG. 5A shows a view of a lamp assembly according to an embodiment of the invention.

FIG. 5A shows one example of a single strip EL assembly 500. The EL assembly 500 includes a flexible conductor portion 510, a first EL strip 520, and a second EL strip 522. Although two EL strips are shown in this example, one EL strip, or several EL strip embodiments are also contemplated within the scope of the invention. In one embodiment, the flexible conductor portion 510 includes a substantially flat flex-circuit material. A number of conductors 512 such as trace conductors on a flex circuit are included to transmit power, or electrical signals to and from the EL strips. In one embodiment, an electrical connector 530 is also included for attachment to additional circuitry or a power source, etc.

Figure 5B:
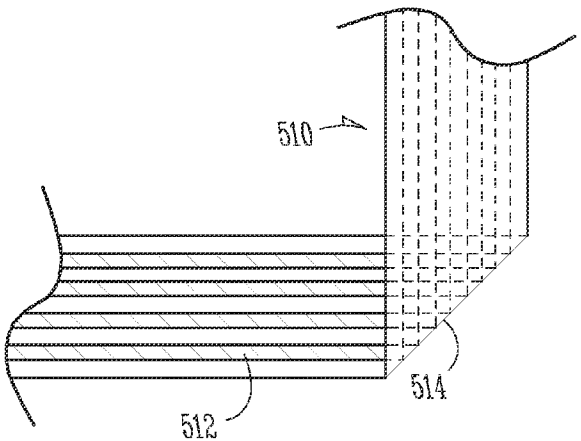
FIG. 5B shows a detail view of a portion of a lamp assembly according to an embodiment of the invention.

FIG. 5B shows the flexible conductor portion 510 in greater detail. One example of a fold 514 is shown for orienting selected portions of the EL assembly 500. Selected embodiments of vests and other articles of safety clothing disclosed in the present application utilize a single EL assembly 500 to illuminate multiple portions of the article of safety clothing. One advantage to the use of a single EL assembly 500 is that only a single power supply is needed to operate the article of safety clothing. This provides ease of use, and reduces manufacturing costs in production of the safety clothing.

Figure 6:
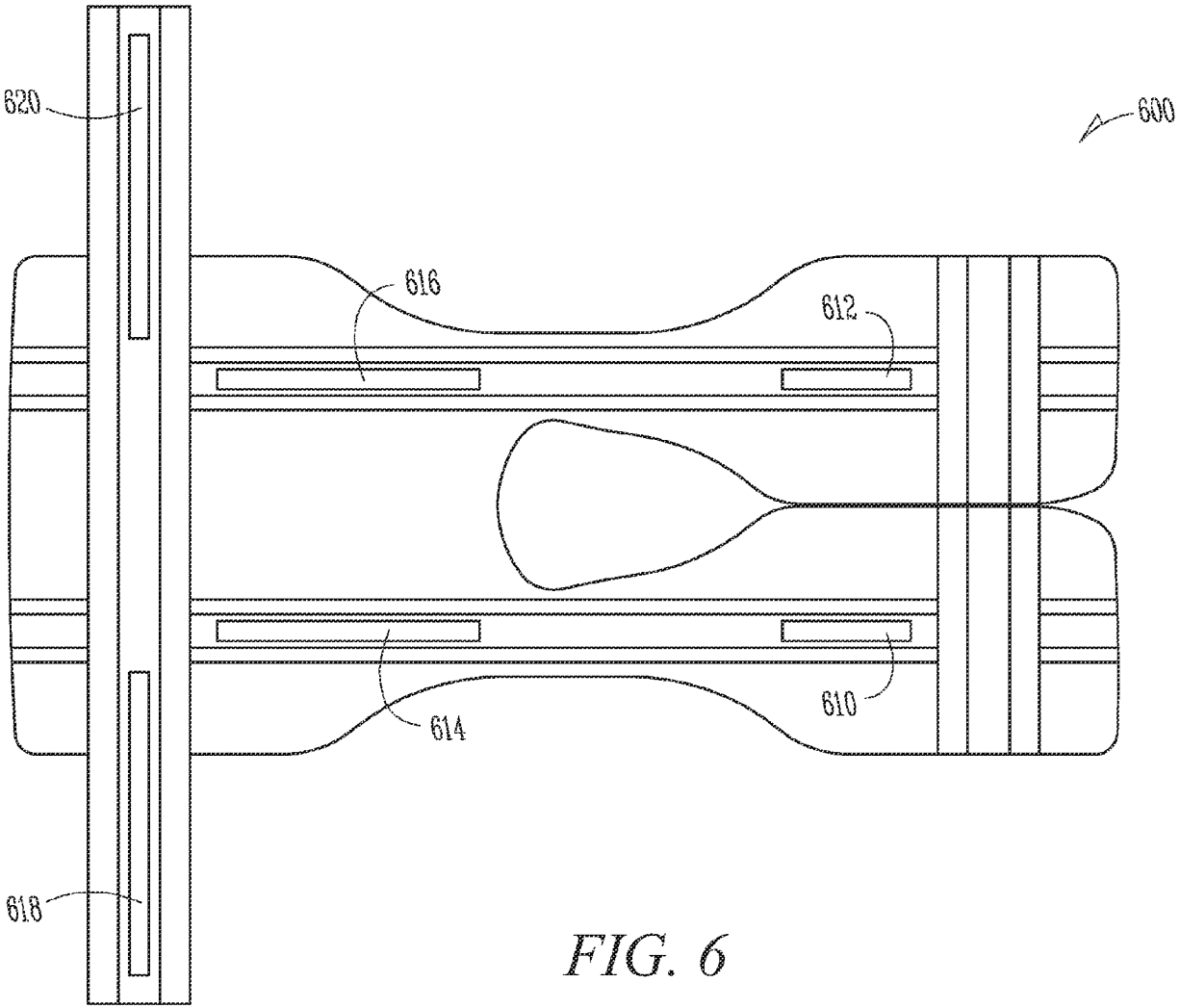
FIG. 6 shows a flat view of a vest according to an embodiment of the invention.

Referring to FIG. 6, there is illustrated yet another example embodiment of a vest 600 that is similar to that of FIGS. 1 and 2 except that EL lamp strips 610 and 612 on the front run from the bottom edge of the vest upwards approximately 4 inches. In the back, EL lamp strips 614 and 616 extend on the back of the vest from about the shoulder (but, in one embodiment, not on top of the shoulder so as to avoid light from the lamp distracting a wearer of the vest) to the bottom waist area of the vest. Further, there are provided EL strips 618 and 620 in the waist band/belt. In one embodiment, the EL strips 610-620 are held in place in polyurethane sleeves as described above.

In one example embodiment, EL strips 618 and 620 are positioned such that during normal use are provided at least a portion of EL strips 618 and 620 are visible along a side portion of the vest 600, and are situated for the purpose of providing an EL lamp that is visible to oncoming traffic when safety personnel are turned sideways to the direction of traffic. One example includes when a safety officer is facing toward the drivers window of a vehicle stopped by the side of the road.

Thus, according to the embodiment 600, "glow up" into a wearer's face is minimized such that this light does not annoy the wearer, or interfere with the wearer's ability to see forward. Also, the side profile glow provided by this embodiment enhances the visibility of the wearer when in the vulnerable position of standing sideways to oncoming traffic.

In one embodiment, the EL lamp strips are a lemon yellow color when on. Lemon yellow provides an advantageous highly visible color that is also consistent with standards set for safety vests and other such articles of clothing to maximize visibility. Various shades of yellow colors are also contemplated within the scope of the invention. Highly visible colors other than yellow, such as blaze orange, light blue, etc. are also contemplated within the scope of the invention. In one embodiment, the color of the EL lamp strips is provided by the actual discharge of the lamp elements. In one embodiment, the color of the EL lamp strips is provided, or modified by a tinted, substantially transparent cover that is placed over the EL lamp. One advantage to using a tinted cover to modify a lamp color is that both a lit and unlit color of the EL portion of the clothing can be selected. For example, an EL lamp that is blue when lit, and white when unlit can be covered with a yellow tinted cover. This will produce a green condition when lit, and the EL portion will appear yellow when unlit. This provides good visibility during the daytime, and at night with the same article of clothing.

Figure 10:
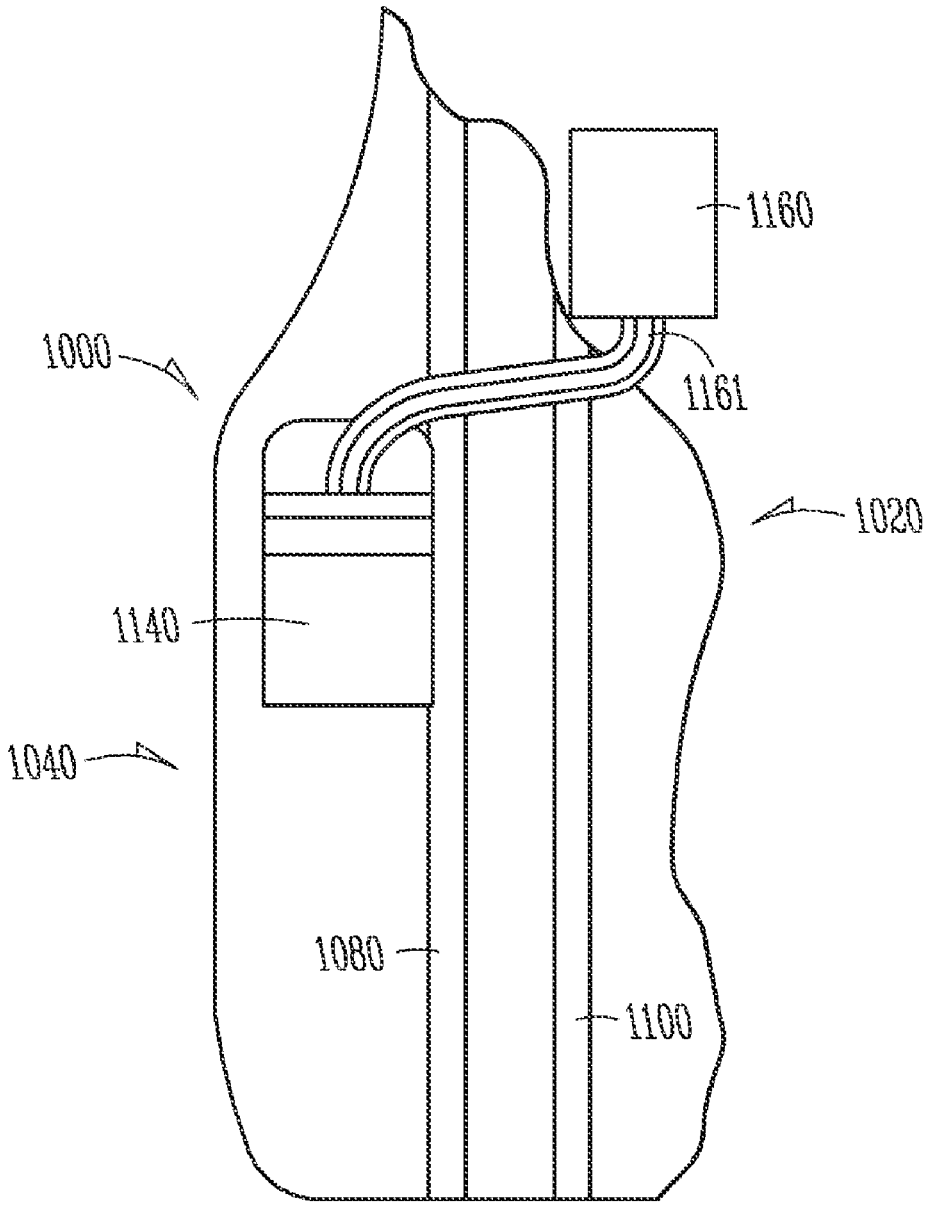
FIG. 10 is a front panel view of a life jacket embodiment of the invention, the life jacket including EL lighting.

Another embodiment, illustrated at 100 in FIG. 10, includes a life vest having EL lighting. The EL lighting enables rescuers to better find a wearer in distress. The life vest 100 includes a vest main body 102 with a front component 104 and a rear component which is not shown. Each of the front component 104 and the rear components includes designs 108 and 110 that are lit by EL lighting. The EL lighting battery (not shown) is stored in a waterproof container 116 in pocket 114. Other electrical components used in EL lighting the life vest are also waterproofed, using conventional methods. While the designs 109 and 110 are shown, it is understood that other design embodiments are suitable for use in the life vest of the invention.

Figure 7:
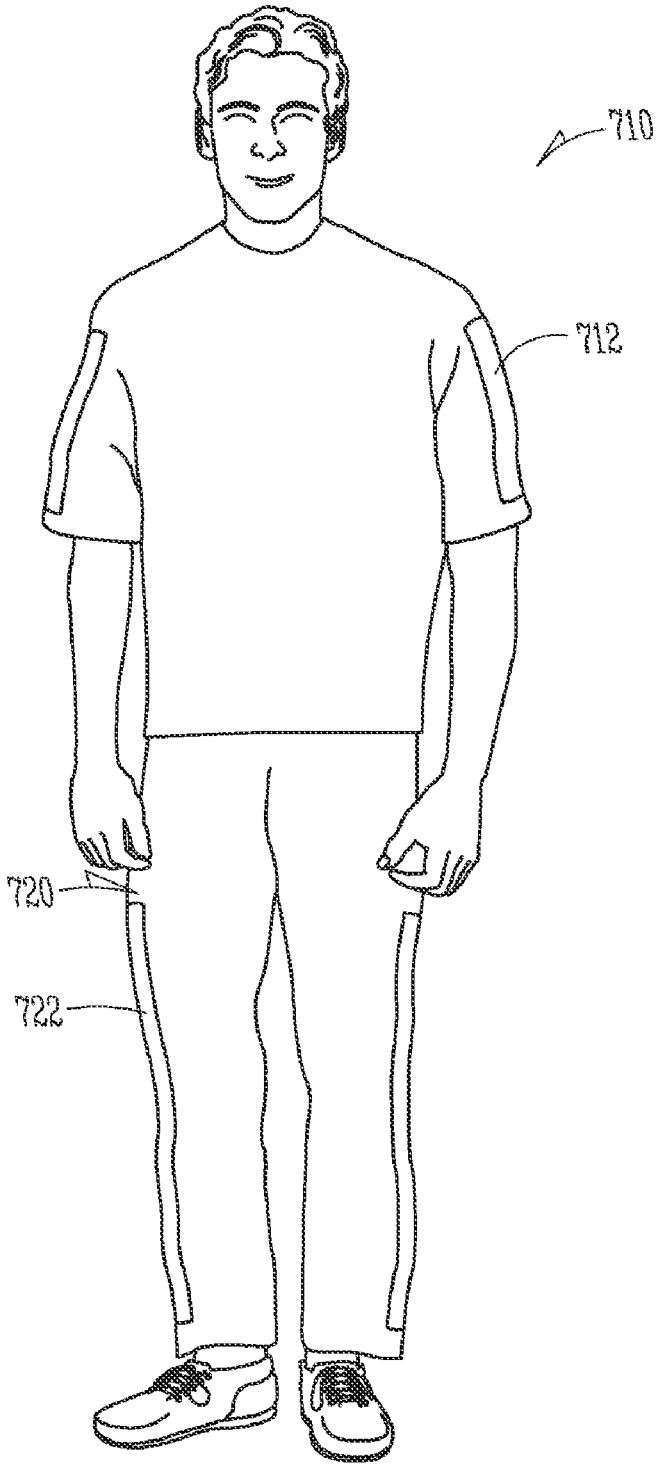
FIG. 7 shows a view of safety clothing according to an embodiment of the invention.
Figure 8:
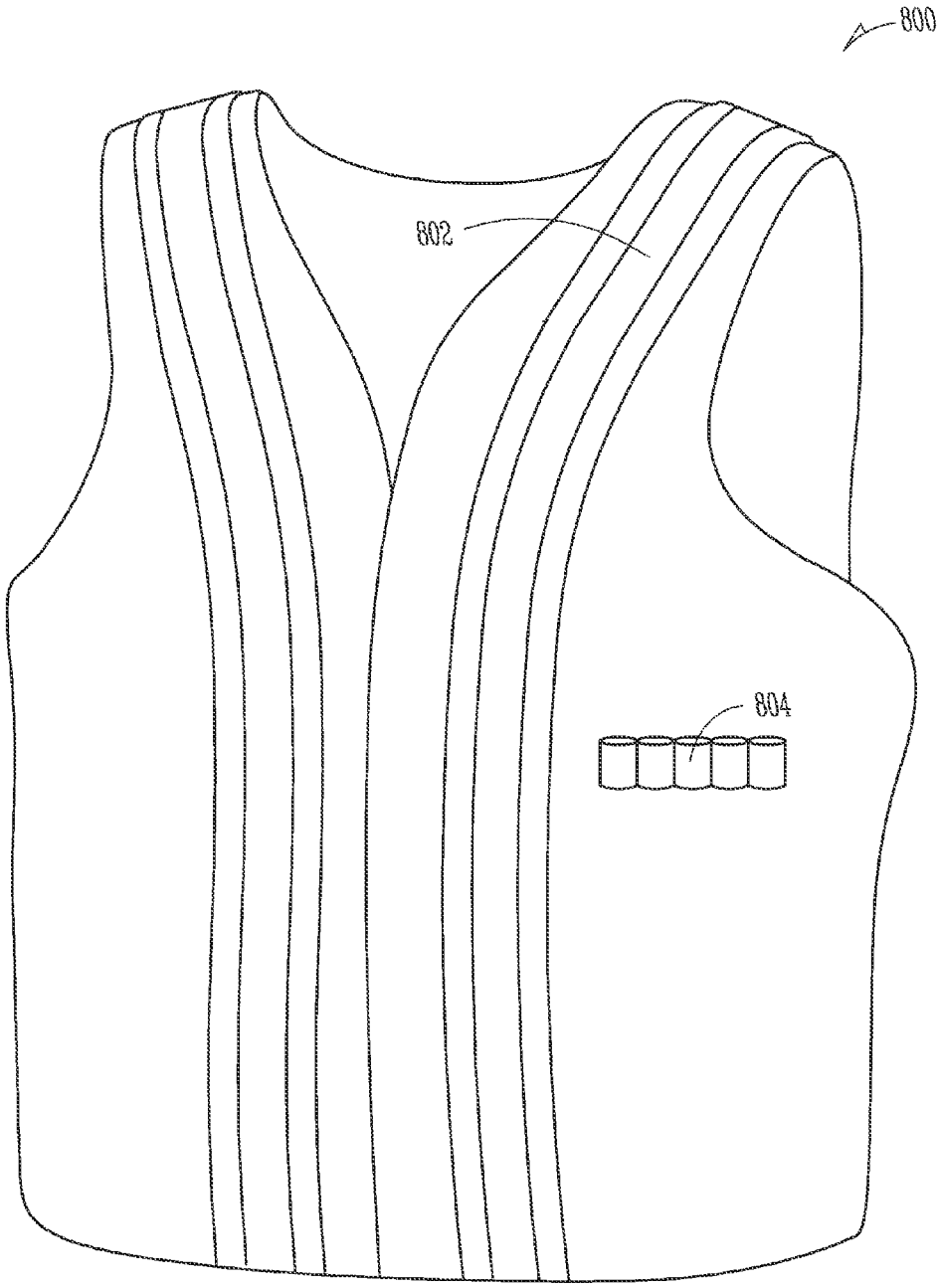
FIG. 8 shows a view of a hunting vest according to an embodiment of the invention.

It shall be further realized that, according to other example embodiments, the EL lamp strips may be used as illustrated above, or in other configurations, in combination or alone with reflective materials on other articles of clothing such as jogging or walking suits or shorts, pants, shirts, sweatshirts, hats or other such articles of clothing. FIG. 7 shows a user wearing a shirt 710 with at least one EL lighting strip 712. FIG. 7 further shows the user wearing a pair of pants 720 with at least one EL lighting strip 722. Pant embodiments include but are not limited to athletic pants, pants worn as part of a uniform, safety pants, such as are worn by firemen. Furthermore, the combination of EL and reflective material may be used on safety articles worn by a user on top of or in addition to athletic or street clothing. [Para 33]According to another example embodiment shown in FIG. 8, a hunting vest 800 provides that there is one or more EL lamp strips 802 that glow orange when on. Although one configuration of EL lamp strips 802 is illustrated, other configurations are possible without departing from the scope of the invention. Further hunting accessories, such as ammunition holders 804 are included on the hunting vest 800 in one embodiment.

Figure 9A:
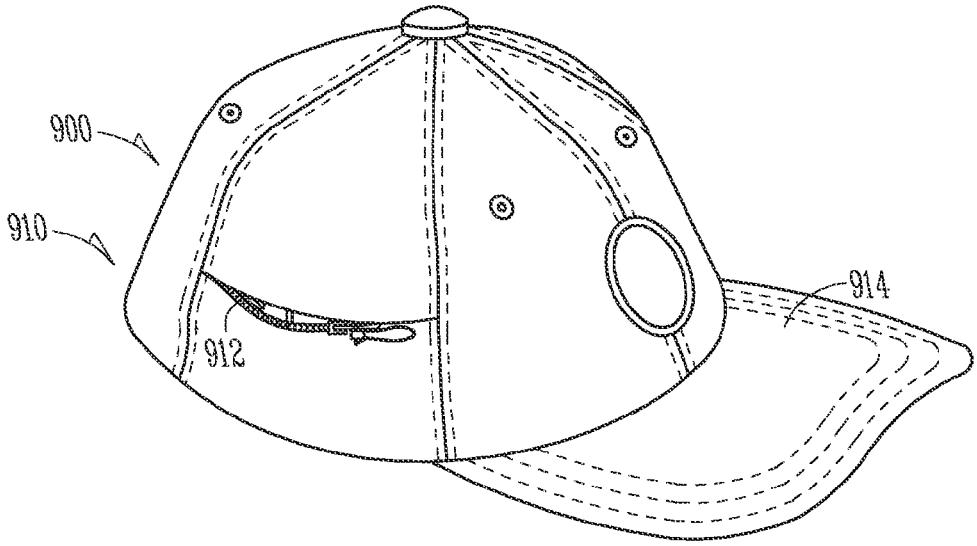
FIG. 9A is a perspective view of a hat with EL lighting.
Figure 9B:
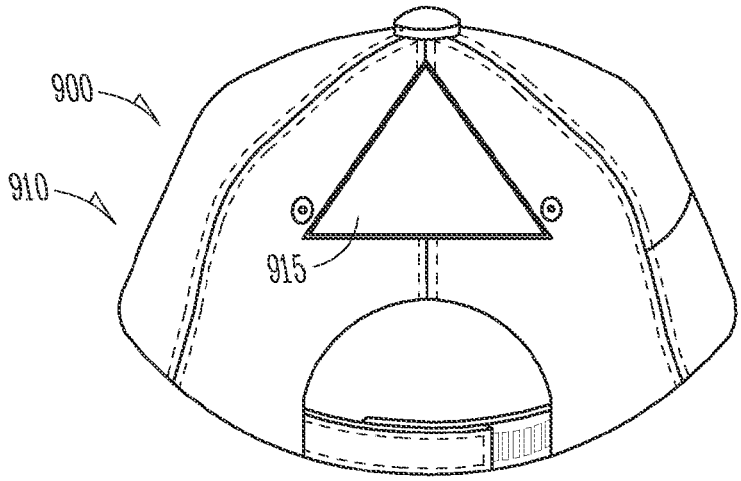
FIG. 9B is a rear view of the hat of FIG. 9A.

One hunting hat is illustrated at 900 in FIGS. 9A and 9B. The hunting hat includes a flexible main hat body 910 with EL lighting 912 illuminating a safety symbol 914, such as a triangle attached to the hat 900. The symbol is adhered with adhesive for some embodiments and is sewn onto the hat main body for other embodiments. While a triangle is shown, it is understood that other safety symbols are suitable for use on the cap 900 of the invention. Other safety symbols include a caution symbol, stop symbol and yield symbol. The flexible main hat body 910 is made of a material such as a fabric or a polymer. The hat body 910 includes a bill 914 that is stiffened. While the hat 900 is described for use in hunting, it is understood that the hat 900 has other safety uses. For instances, the hat 900 provides a safety signal for a wearer driving or sitting as a passenger in a vehicle, such as an auto, truck, four-wheeler, motor home, bus or boat.

Other hat embodiments, containing the EL lighting safety symbol include hard hats, firefighter hats, and helmets such as those worn by motorcyclists, and pilots. These hat embodiments include a rigid hat main body. One rigid hat embodiment is shown at 132 FIG. 10. These hat embodiments also include a safety symbol 137 lit by EL lighting that is adhered to the hat main body 135.

Thus, there is described above a safety vest and other articles and methods that provide for continuously illuminated EL lighting on the vest. It is known that such continuous lighting enhances the safety of the wearer and also the safety of those driving near the wearer, due to the much enhanced visibility of the vest in poor lighting conditions, particularly in inclement weather in which light sources such as headlights are not readily received or reflected back to the source due to moisture or other particles in the air such as snow, rain, steam, dust, etc.

The combination of both the radiation of light from lamp strips and the reflection of light from the reflective surfaces is thus more effective than just either effect on its own, but particularly more effective than just a reflective material alone.

Life vests, collars and other accessories for pets that include EL lighting are additional embodiments of the invention. The life vests, collars and accessories include main bodies, shown at 1000 in FIG. 10, EL lighting attached to the main body, shown at 1100 and 1080 and a battery pack 1160 attached to the main body. The battery pack 1160 and wiring 1161 are waterproofed. The life vest emits a single safety color, such as orange, for one embodiment and two or more colors for other embodiments.

Figure 5C:
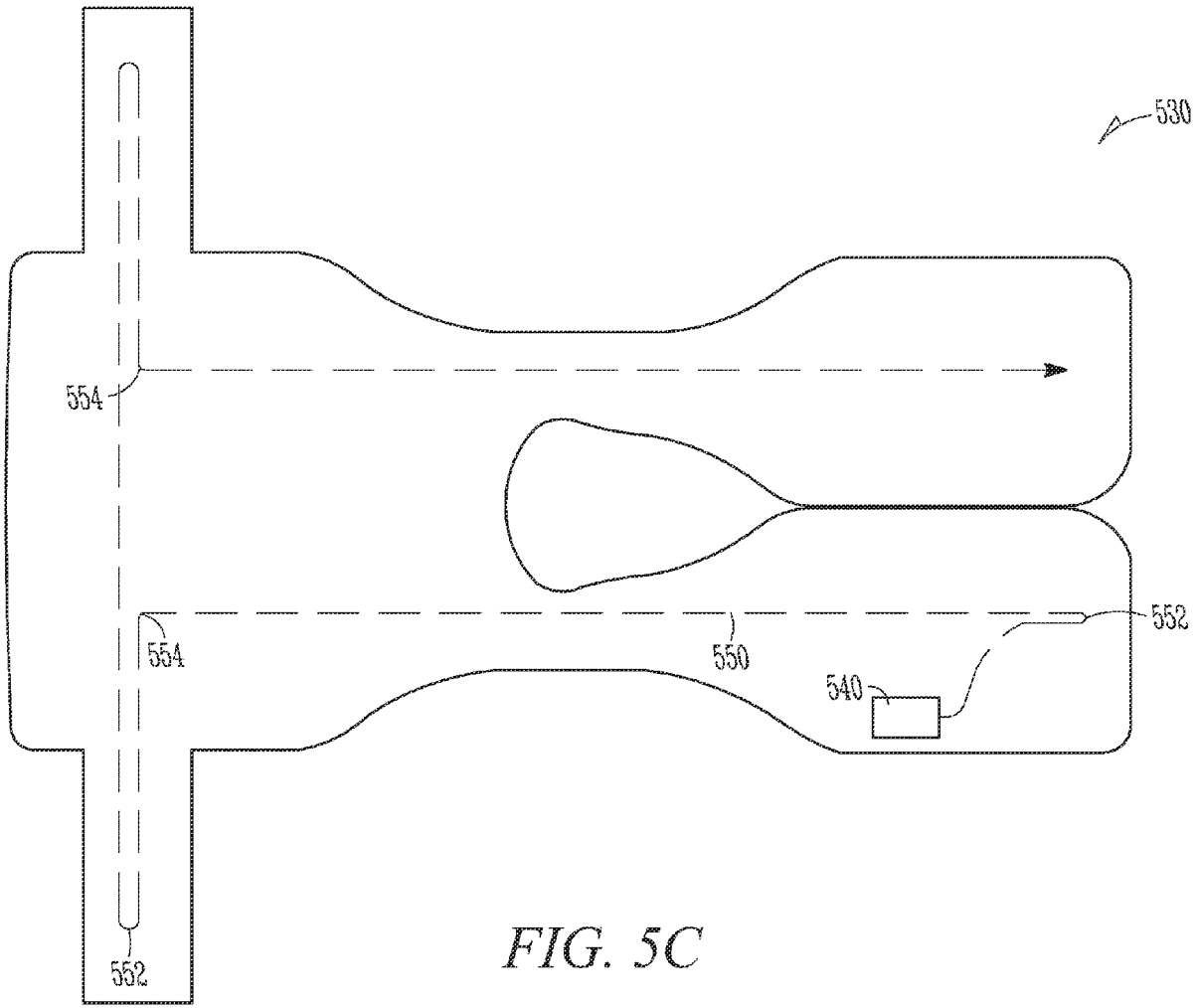
FIG. 5C shows a view of an article of safety clothing according to an embodiment of the invention.
Figure 11:
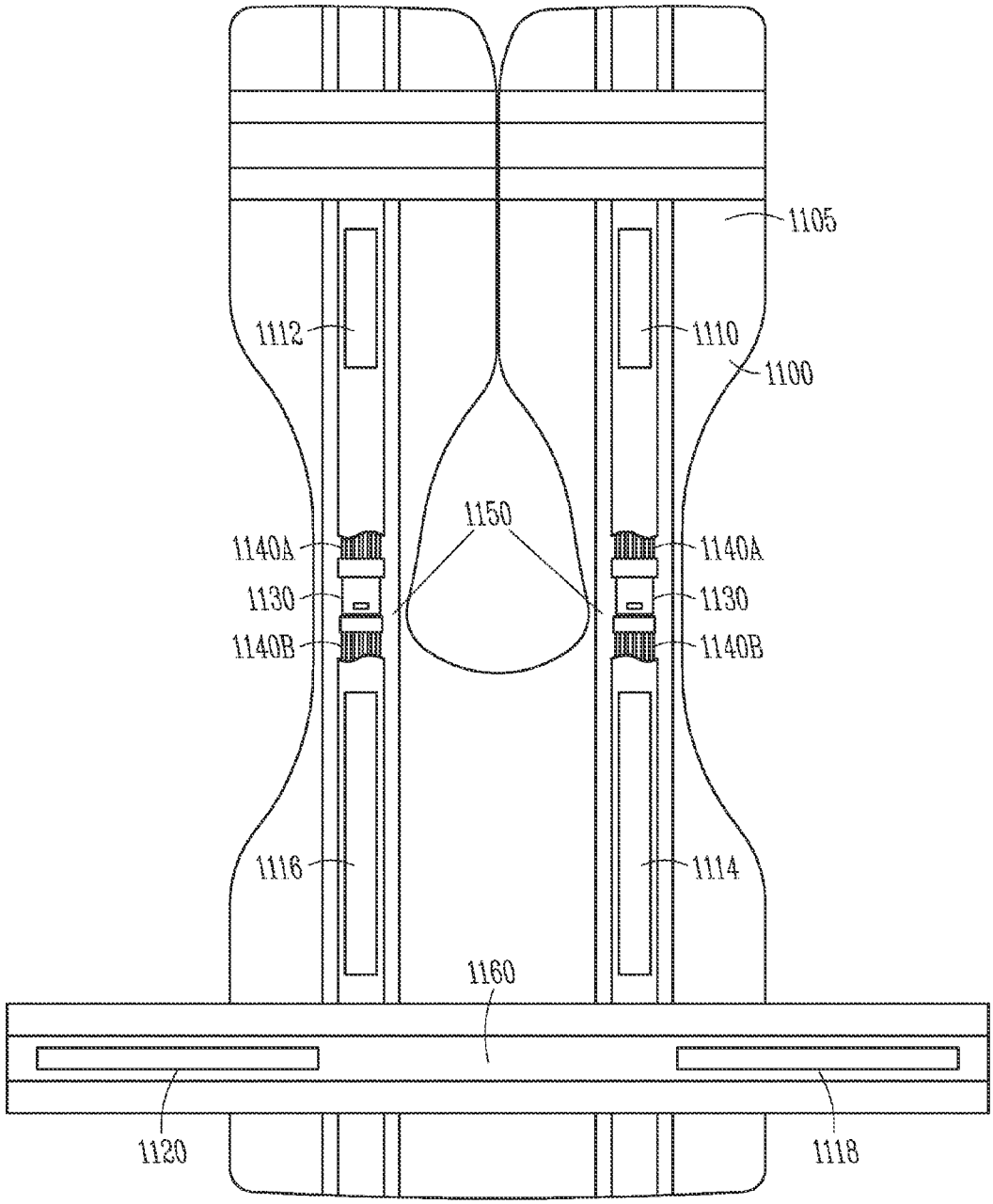
FIG. 11 is a plan view of a tear away safety vest embodiment of the invention.

Referring now to FIG. 11, there is shown an example embodiment of a garment or other article of clothing 1100 with EL lighting and tear away functionality. In one example embodiment, the garment or article 1100 is a safety vest that includes an EL lighting assembly 1105 (represented as a dotted line) as described in more detail above with respect to FIG. 5C and other figures. It includes, for example as also described with respect to FIG. 6, EL lamp strips 1110 and 1112 on the front run from the bottom edge of the article upwards approximately 4 inches. In the back, EL lamp strips 1114 and 1116 extend on the back of the article from about the shoulder (but, in one embodiment, not on top of the shoulder so as to avoid light from the lamp distracting a wearer of the article) to the bottom waist area of the article. Further, there are provided EL strips 1118 and 1120 in the waist band/belt. In one embodiment, the EL strips 1110-1120 are held in place in polyurethane sleeves as described above. In addition, article 1100 is adapted to allow the front or rear of the article to be torn away in the event the article is accidentally caught in a machine or vehicle. In one embodiment, tear away functionality is provided by providing a line of weakness 1150 in the article at the shoulders that allows the article to separate if pulled with sufficient force, and also with a "pull-apart" connector 1130 positioned at about the location of the line of weakness 1150, that connects both sides of the circuit 1140*a* and 1140*b* of EL assembly 1105. The pull-apart connector is, in one example embodiment, a connector that can be pulled apart in the event of a tear away situation, allowing the EL assembly to be separated into front and back portions, and also therefore allow the article 1100 and EL assembly 1105 to be pulled apart into pieces, for example, for tear away functionality along the shoulder of the wearer. Lines of weakness 1150 may be provided with perforations of the article material, or alternatively be provided by attaching the front and back portions of the article along the line of weakness 1150 using Velcro, such that they can be pulled apart at the Velcro connection to provide the desired tear away functionality. Accordingly, in the event that the front of the article is caught, for example, by machinery, the front of the article would break and tear away at the shoulders so as to avoid pulling the wearer into the machinery that catches and pulls the article.

Figure 12:
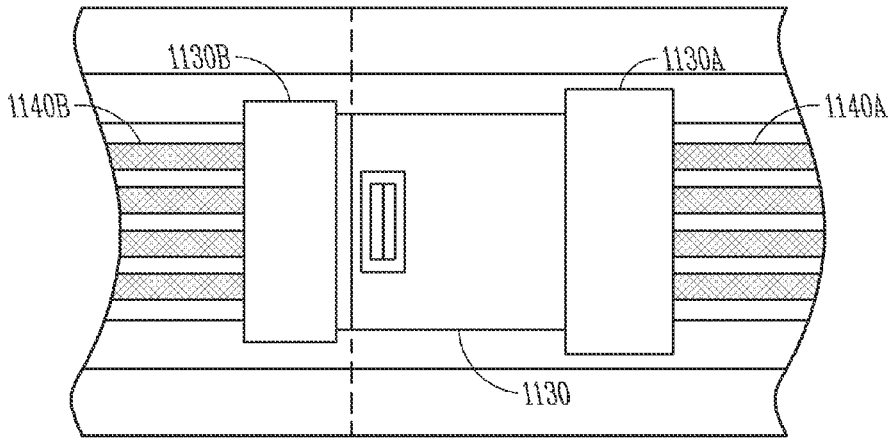
FIG. 12 and FIG. 13 are more detailed view of a pull apart connector used in the embodiment of FIG. 11 or other embodiments.
Figure 13:
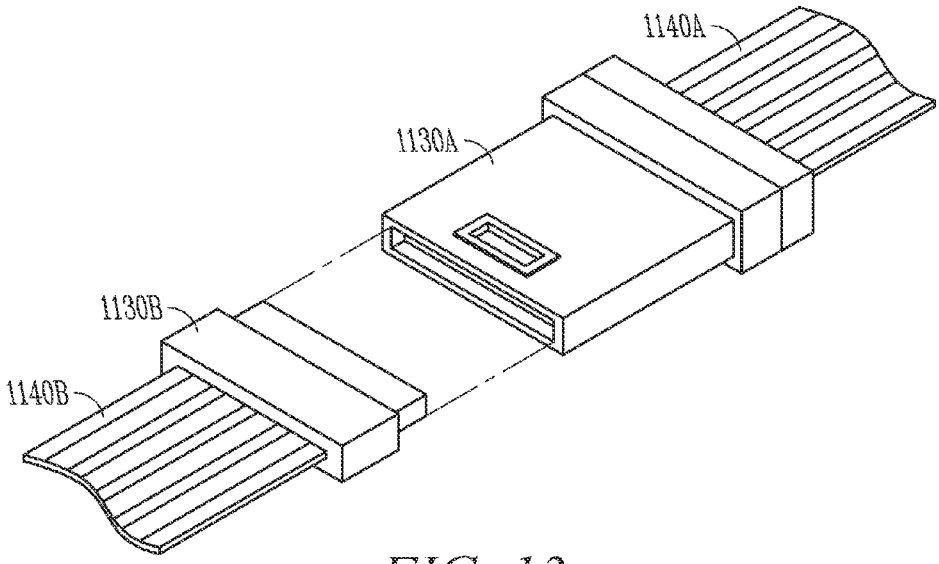

Referring to FIG. 12 and FIG. 13 the pull-apart connector 1130 is shown in more detail. According to one example embodiment, connector 1130 is a four pin connector and includes a female portion 1130*a* and a male portion 1130*b* that is mated with the female portion 1130*a*, and is held together with an interference fit or detent, for example. According to one embodiment, the male and female portions should be held together when mated sufficiently to prevent unwanted disconnection during normal use, but in addition should offer minimal resistance to being pulled apart from one another in the event the article tears away along the lines of weakness 1150. Female portion 1130*a* and male portion 1130*b* are mechanically and electrically connected, respectively, to the circuit element 1140*a* and 1140*b*, which in one example embodiment is a flexible printed circuit with four conductors which are connected respectively to the four pins of the connector 1130 to provide a through connection from one circuit element 1140*a* or 1140*b* to the other. According to one example embodiment, connector 1130 may be a connector sold by AMP, Incorporated, or Harrisburg, Pa., 17105, that provides the desired ability to maintain the connection during normal use but also allows the connector to be pulled apart easily enough to provide the needed tear away functionality. Such AMP connectors may be flexible film connectors, for example but not by way of limitation, single row pin and receptacle housings type connectors that can be used with flexible printed circuit connectors. In other example embodiments any other type of connector may be used that provides the desired pull-apart functionality to provide the desired tear away functionality.

According to another embodiment, the EL assembly may itself be constructed so that it can be pulled apart without using a connector, for example by providing a solder joint that can be easily broken by pulling on the circuit elements on either side of the solder joint, or by other means as may be devised that would allow the circuit to be physically broken apart to provide the tear away functionality required. According to still another example embodiment, the line of weakness and corresponding pull-apart circuit capability may be provided in more than one location on the article. For example, such line of weakness and pull-apart circuit capability may be provided on a portion of circuit near the waist, such as at point 1160 as shown in FIG. 11.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

The invention claimed is:

1. Apparatus, comprising:

a garment sized to be worn by a human, the garment having a front and back side to face one another defining a right arm space and a left arm space between them, wherein the front and back side are coupled at a right line of weakness and a left line of weakness, with the right arm space extending away from the right line of weakness to a right portion of a releasably coupled belt of the garment, with the front and back side separated from one another from the right line of weakness to the right portion of the releasably coupled belt, and the left arm space extending away from a left line of weakness to a left portion of the releasably coupled belt of the garment, with the front and back side separated from one another from the left line of weakness to the left portion of the releasably coupled belt, the garment adapted to separate along the line of weakness when the front side is pulled from the back side with a sufficient force, the front side including a left and right front portion releasably joined at a front seam and sized to extend at least from a waist of the human to the shoulder of the human to partially define a neck opening, with the front seam extending from a bottom of the garment to the neck opening;

at least one electroluminescent (EL) lighting element positioned on the front portion of each of the left and right front side of the garment; and at least one EL circuit that connects the EL lighting elements and includes at least one separable portion that can be pulled apart when the front side is pulled from the back side with the sufficient force, the separable portion of the EL circuit aligned proximate to the line of weakness, wherein the line of weakness and the separable portion of the EL circuit provide tear away functionality for at least a portion of the garment.

2. Apparatus comprising:

an article of clothing including at least one electroluminescent (EL) lighting circuit having a first portion connected to a first area of the article of clothing, and at least one second portion connected to another area of the article of clothing, the first area of clothing and the another area of clothing coupled to face one another defining a right arm space and a left arm space between them, the first portion and second portion coupled along a right line of weakness and a left line of weakness, with the right arm space extending away from the right line of weakness to a right portion of a releasably coupled belt of the garment, with the front and back side separated from one another from the right line of weakness to the right portion of the releasably coupled belt, and the left arm space extending away from a left line of weakness to a left portion of the releasably coupled belt of the garment, with the front and back side separated from one another from the left line of weakness to the left portion of the releasably coupled belt, the article adapted to separate along the line of weakness when the first area is pulled from the another area with a sufficient force, the first portion including a left and right front portion releasably joined at a seam and sized to extend at least from a waist of the human to the shoulder of the human to partially define a neck opening, with the seam extending from a bottom of the garment to the neck opening;

the EL lighting circuit including at least one disconnection area aligned proximate the line of weakness;

the disconnection area allowing the first portion to be freely separated from the second portion if the first area of the article of clothing is pulled or torn apart from the another area of the article of clothing with the sufficient force.

3. Apparatus comprising:

an EL lighting assembly including at least one electroluminescent (EL) lighting circuit having a first portion that may be connected to a first area of an article of clothing, and at least one second portion that may be connected to another area of the article of clothing, with the first area of the article of clothing connected to face one another defining a right arm space and a left arm space between them, the first portion and second portion connected to the another area along a right line of weakness and a left line of weakness, with the right arm space extending away from the right line of weakness to a right portion of a releasably coupled belt of the garment, with the front and back side separated from one another from the right line of weakness to the right portion of the releasably coupled belt of the garment, and the left arm space extending away from a left line of weakness to a left portion of the releasably coupled belt of the garment, with the front and back side separated from one another from the left line of weakness to the left portion of the releasably coupled belt of the garment, the article of clothing adapted to separate along the line of weakness when the first portion is pulled apart from the second portion with a sufficient force, the first portion including a left and right front portion releasably joined at a seam and sized to extend at least from a waist of the human to the shoulder of the human to partially define a neck opening, with the seam extending from a bottom of the garment to the neck opening;

the lighting circuit including at least one disconnection area between the first and second portions of the lighting circuit with the disconnection area to be disposed proximate the line of weakness; and the disconnection area allowing the first portion to be freely separated from the second portion when the first area of the article of clothing is pulled apart from the other article of clothing with the sufficient force.

4. The apparatus of claim 1, wherein the front and back side are coupled along a shoulder portion at the line of weakness, with the garment including another line of weakness along a waist portion, the waist portion to be located along a waist of the human, with a further separable portion of the EL circuit extending across the waist portion.

5. The apparatus of claim 1, wherein the front and back side are coupled along a shoulder portion at the line of weakness, with the garment including a belt to couple the front and back side, the belt to extend along a waist portion of the human.

6. The apparatus of claim 5, wherein the belt is to releasably couple the front and back side.

7. The apparatus of claim 6, wherein the belt is to couple via a hook and loop fastener.

8. The apparatus of claim 5, wherein the separable portion includes a connector.

9. The apparatus of claim 8, wherein the line of weakness comprises a hook and loop fastener.

10. The apparatus of claim 1, wherein the line of weakness comprises perforated material.

11. The apparatus of claim 2, wherein the first area and the other area of the article of clothing are coupled along a shoulder portion at the line of weakness, with the article of clothing including another line of weakness along a waist portion, the waist portion to be located along a waist of the human, with a further disconnection area of the EL circuit extending across the waist portion.

12. The apparatus of claim 2, wherein the front and back side are coupled along a shoulder portion at the line of weakness, with the article of clothing including a belt to couple the front and back side, the belt to extend along a waist portion of the human.

13. The apparatus of claim 2, wherein the disconnection area includes a connector.

14. The apparatus of claim 13, wherein the line of weakness comprises a hook and loop fastener.

15. The apparatus of claim 2, wherein the line of weakness comprises perforated material.

16. The apparatus of claim 3, wherein the first area and the other area of the article of clothing are coupled along a shoulder portion at the line of weakness, with the article of clothing including another line of weakness along a waist portion, the waist portion to be located along a waist of the human, with a further disconnection area of the EL circuit extending across the waist portion.

17. The apparatus of claim 3, wherein the front and back side are coupled along a shoulder portion at the line of weakness, with the article of clothing including a belt to couple the front and back side, the belt to extend along a waist portion of the human.

18. The apparatus of claim 3, wherein the separable portion includes a connector.

19. The apparatus of claim 18, wherein the line of weakness comprises a hook and loop fastener.

20. The apparatus of claim 3, wherein the line of weakness comprises perforated material.

* * * * *